US006869164B2

(12) United States Patent
Johnson et al.

(10) Patent No.: US 6,869,164 B2
(45) Date of Patent: Mar. 22, 2005

(54) MAINTENANCE STATION HAVING ACOUSTICAL DAMPENING FOR USE IN AN IMAGING APPARATUS

(75) Inventors: Martin Alan Johnson, Winchester, KY (US); Daniel Robert LaBar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 12 days.

(21) Appl. No.: 10/448,161

(22) Filed: May 29, 2003

(65) Prior Publication Data

US 2004/0239719 A1 Dec. 2, 2004

(51) Int. Cl.[7] ..... B41J 2/165
(52) U.S. Cl. ..... 347/32; 347/33
(58) Field of Search ..... 347/22, 29, 33, 347/32

(56) References Cited

U.S. PATENT DOCUMENTS

| | | | | |
|---|---|---|---|---|
| 3,944,029 | A | 3/1976 | Jozuka | 188/282 |
| 4,197,024 | A | 4/1980 | Huntoon | 400/636 |
| 4,943,173 | A | 7/1990 | Okazaki et al. | 400/689 |
| 5,065,158 | A | 11/1991 | Nojima et al. | 346/140 |
| 5,115,250 | A | 5/1992 | Harmon et al. | 346/1.1 |
| 5,151,715 | A | 9/1992 | Ward et al. | 346/140 |
| 5,396,271 | A | 3/1995 | Premnath | 347/33 |
| 5,440,331 | A | 8/1995 | Grange | 347/32 |
| 5,563,638 | A | 10/1996 | Osborne | 347/32 |
| 5,585,826 | A | 12/1996 | Schroeder et al. | 347/29 |
| 5,602,573 | A | 2/1997 | Waschhauser et al. | 347/33 |
| 5,610,641 | A | 3/1997 | Ikado | 347/33 |
| 5,621,441 | A | 4/1997 | Waschhauser et al. | 347/33 |
| 5,627,573 | A | 5/1997 | Fahy | 347/32 |
| 5,627,574 | A | 5/1997 | Fahy | 347/33 |
| 5,644,347 | A | 7/1997 | Schwiebert et al. | 347/33 |
| 5,812,157 | A | 9/1998 | Nguyen et al. | 347/32 |
| 5,867,185 | A | 2/1999 | Yun | 347/29 |
| 5,949,448 | A | 9/1999 | Man et al. | 347/33 |
| 6,135,585 | A | 10/2000 | Johnson et al. | 347/32 |
| 6,137,504 | A | 10/2000 | Kawai et al. | 347/33 |
| 6,168,257 | B1 | 1/2001 | Aldrich | 347/32 |
| 6,193,357 | B1 | 2/2001 | Medin | 347/33 |
| 6,244,765 | B1 | 6/2001 | Harriman et al. | 400/319 |
| 6,315,386 | B1 | 11/2001 | Bailey et al. | 347/22 |
| 6,343,850 | B1 | 2/2002 | Domagall | 347/33 |
| 6,398,340 | B1 | 6/2002 | Lin | 347/33 |
| 6,402,290 | B1 | 6/2002 | Johnson et al. | 347/32 |
| 6,402,291 | B1 | 6/2002 | Millman et al. | 347/33 |
| 6,422,679 | B1 | 7/2002 | Aldrich | 347/22 |
| 2001/0000434 | A1 | 4/2001 | Medin | 347/33 |
| 2001/0007459 | A1 | 7/2001 | Midorikawa | 347/33 |
| 2002/0015070 | A1 | 2/2002 | Taylor et al. | 347/32 |
| 2002/0075349 | A1 | 6/2002 | Sawicki | 347/33 |

*Primary Examiner*—Shih-Wen Hsieh
(74) *Attorney, Agent, or Firm*—Taylor & Aust P.C.

(57) ABSTRACT

An imaging apparatus includes a frame, and a maintenance station coupled to the frame. The maintenance station includes a maintenance housing having an end portion. A maintenance sled is movably mounted to the maintenance housing. The maintenance sled has a first position and a second position. A flexible member is mounted to the maintenance sled. The flexible member includes a main body and an elastic portion extending from the main body. The main body and the elastic portion define a cavity. The elastic portion of the flexible member contacts the end portion of the maintenance housing when the maintenance sled is in the first position.

21 Claims, 5 Drawing Sheets

MAINTENANCE STATION HAVING ACOUSTICAL DAMPENING FOR USE IN AN IMAGING APPARATUS

BACKGROUND OF THE INVENTION

1. Field of the Invention

The present invention relates to a maintenance station for use in an imaging apparatus and, more particularly, to a maintenance station having acoustical dampening.

2. Description of the Related Art

An imaging apparatus, such as an ink jet printer, includes a maintenance station that performs maintenance operations to preserve the life of the associated printhead. For example, an ink jet printer includes an ink jet printhead having a plurality of ink jetting nozzles formed in a nozzle plate. Such a maintenance station for an ink jet printer includes a printhead wiper and a printhead capping mechanism. The printhead wiper is used for wiping residual ink from the nozzles of the ink jet printhead after completion of printing and the capping mechanism is used to cap the ink jet printhead for storage. The wiping and capping operations prevent the nozzles from becoming blocked with contaminants, such as dried ink and accumulated paper dust, thereby extending the life of the ink jet printhead.

One such maintenance station is configured to minimize the occupied space. The maintenance station includes a movable maintenance sled, that supports the wiper and capping mechanism. A maintenance housing surrounds the maintenance sled and includes guide slots for receiving corresponding guide pins of the maintenance sled. When the printhead carrier that carries the ink jet printhead carriage engages an engaging member of the maintenance station, the guide pins are caused to ride in the guide slots, enabling the movable maintenance sled to be shifted from a lowered position to a raised position, where the printhead cap engages the ink jet printhead. Typically, a spring is disposed between the maintenance sled and the maintenance housing to facilitate the return of the movable maintenance sled from the raised position to the lowered position. However, when the movable maintenance sled returns from the raised position to the lowered position by virtue of the spring, an unacceptable amount of noise is generated as the maintenance sled impacts another portion of the printer, such as the printer mid-frame, and/or as the guide pins of the maintenance sled contact a surface of the respective guide slots in the maintenance housing, such as the rigid end-stops of the respective guide slots of the maintenance housing.

What is needed in the art is a maintenance station that includes a mechanism to reduce the noise associated with the return of the maintenance sled to the lowered position.

SUMMARY OF THE INVENTION

The present invention provides a maintenance station that includes a mechanism to reduce the noise associated with the return of the maintenance sled to the lowered position.

The invention, in one form thereof, relates to an imaging apparatus. The imaging apparatus includes a frame, and a maintenance station coupled to the frame. The maintenance station includes a maintenance housing having an end portion. A maintenance sled is movably mounted to the maintenance housing. The maintenance sled has a first position and a second position. A flexible member is mounted to the maintenance sled. The flexible member includes a main body and an elastic portion extending from the main body. The main body and the elastic portion define a cavity. The elastic portion of the flexible member contacts the end portion of the maintenance housing when the maintenance sled is in the first position.

In another form thereof, the invention relates to a method of providing acoustical dampening in a maintenance station for an imaging apparatus. The method includes the steps of providing a maintenance sled movably mounted to a maintenance housing, the maintenance sled having a lowered position and an elevated position; providing a flexible member mounted to the maintenance sled, the flexible member including a main body and an elastic portion extending from the main body, the main body and the elastic portion defining a cavity; and moving the maintenance sled toward the lowered position, the elastic portion of the flexible member contacting the end portion thereby deforming the elastic portion.

In still another form thereof, the invention relates to a printhead wiper. The printhead wiper includes a body defining a mounting opening. An elastic portion extends from the main body, the main body and the elastic portion defining a cavity.

An advantage of the present invention is the noise associated with the maintenance station is reduced without increasing the overall length of the maintenance sled.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, in one form, and such exemplifications are not to be construed as limiting the scope of the invention in any manner.

DETAILED DESCRIPTION OF THE INVENTION

Figure 1:
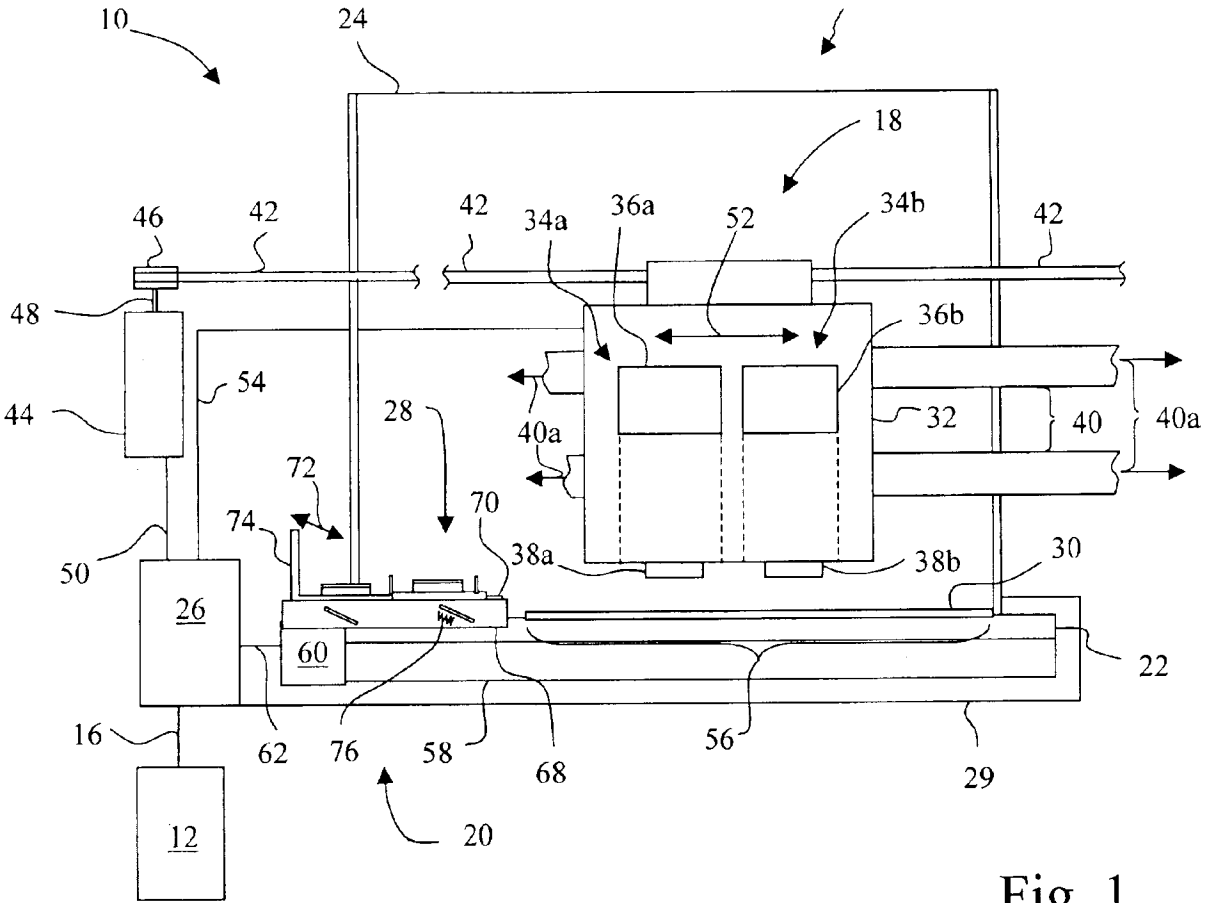
FIG. 1 is a diagrammatic representation of an imaging system employing an embodiment of the present invention.

Referring now to the drawings and more particularly to FIG. 1, there is shown an imaging system 10 employing an embodiment of the present invention. Imaging system 10 includes a computer 12 and an imaging apparatus in the form of an ink jet printer 14. Computer 12 is communicatively coupled to ink jet printer 14 by way of communications link 16. Communications link 16 may be, for example, a wired connection, an optical connection, such as an optical or r.f. connection, or a network connection, such as an Ethernet Local Area Network.

Computer 12 is typical of that known in the art, and includes a monitor to display graphics or text, an input device such as a keyboard and/or mouse, a microprocessor and associated memory, such as random access memory (RAM), read only memory (ROM) and a mass storage device, such as CD-ROM or DVD hardware. Resident in the memory of computer 12 is printer driver software. The printer driver software places print data and print commands in a format that can be recognized by inkjet printer 14.

Ink jet printer 14 includes a printhead carrier system 18, a feed roller unit 20, a mid-frame 22, a media source 24, a controller 26 and a maintenance station 28. Printhead carrier system 18, feed roller unit 20, mid-frame 22, media source 24, controller 26 and maintenance station 28 are mounted to a printer frame 29.

Media source 24 is configured and arranged to supply from a stack of print media a sheet of print media 30 to feed roller unit 20, which in turn further transports the sheet of print media 30 during a printing operation.

Printhead carrier system 18 includes a printhead carrier 32 that carries, for example, one or more printhead cartridges, such as a monochrome printhead cartridge 34*a* and/or a color printhead cartridge 34*b*, that is mounted thereto. Monochrome printhead cartridge 34*a* includes a monochrome ink reservoir 36*a* provided in fluid communication with a monochrome ink jet printhead 38*a*. Color printhead cartridge 34*b* includes a color ink reservoir 36*b* provided in fluid communication with a color ink jet printhead 38*b*. Alternatively, ink reservoirs 36*a*, 36*b* may be located off-carrier, and coupled to respective ink jet printheads 38*a*, 38*b* via respective fluid conduits.

Printhead carrier 32 is guided by a pair of guide rods 40. The axes 40*a* of guide rods 40 define a bi-directional scanning path 52 of printhead carrier 32. Printhead carrier 32 is connected to a carrier transport belt 42 that is driven by a carrier motor 44 via a carrier pulley 46. Carrier motor 44 can be, for example, a direct current motor or a stepper motor. Carrier motor 44 has a rotating motor shaft 48 that is attached to carrier pulley 46. Carrier motor 44 is electrically connected to controller 26 via a communications link 50. At a directive of controller 26, printhead carrier 32 is transported, via the rotation of carrier pulley 46 imparted by carrier motor 44, in a reciprocating manner, back and forth along guide rods 40.

Ink jet printheads 38*a*, 38*b* are electrically connected to controller 26 via a communications link 54. Controller 26 supplies electrical address and control signals to ink jet printer 14, and in particular, to the ink jetting actuators of ink jet printheads 38*a*, 38*b*, to effect the selective ejection of ink from inkjet printheads 38*a*, 38*b*.

During a printing operation, the reciprocation of printhead carrier 32 transports ink jet printheads 38*a*, 38*b* across the sheet of print media 30 along bi-directional scanning path 52, i.e. a scanning direction, to define a print zone 56 of ink jet printer 14. Bi-directional scanning path 52, also referred to as scanning direction 52, is parallel with axes 40*a* of guide rods 40, and is also commonly known as the horizontal direction. The sheet of print media 30 is transported through print zone 56 by the rotation of feed roller 58 of feed roller unit 20. A rotation of feed roller 58 is effected by drive unit 60. Drive unit 60 is electrically connected to controller 26 via a communications link 62.

During each scan of printhead carrier 32, the sheet of print media 30 is held stationary by feed roller unit 20. Feed roller unit 20 includes a feed roller 58 and a drive unit 60.

Maintenance station 28 is provided for performing printhead maintenance operations on the ink jet nozzles of ink jet printheads 38*a*, 38*b*. Such operations include, for example, a printhead spit maintenance operation, a printhead wiping operation and a printhead maintenance capping operation. Other services, such as for example, printhead priming and suction, may also be performed if desired by the inclusion of a vacuum device (not shown) of the type well known in the art.

Maintenance station 28 includes a maintenance housing 68 that supports a movable maintenance sled 70, of a type which is well known in the art, that is configured for movement in the directions generally depicted by double-headed arrow 72. The directions generally depicted by double-headed arrow 72 include both horizontal and vertical components. Maintenance sled 70 includes a carrier engagement member 74. Maintenance sled 70 is biased by a biasing spring 76 in a direction toward printhead carrier 32. The spring force exerted by biasing spring 76 must be sufficient to accelerate maintenance sled 70 and its associated components to the lowered (resting) position so that they are clear of printhead carrier 32 and ink jet printheads 38*a*, 38*b*.

With the orientation of components as shown in FIG. 1, a leftward movement of printhead carrier 32 causes printhead carrier 32 to engage carrier engagement member 74, thereby causing maintenance sled 70 to move to the left and upward, as illustrated by arrow 72. When released, maintenance sled 70 moves to the right and downward, as illustrated by arrow 72, by the force exerted by biasing spring 76. The components and operational details for maintenance station 28 will be described in further detail with respect to FIG. 2.

Figure 2:
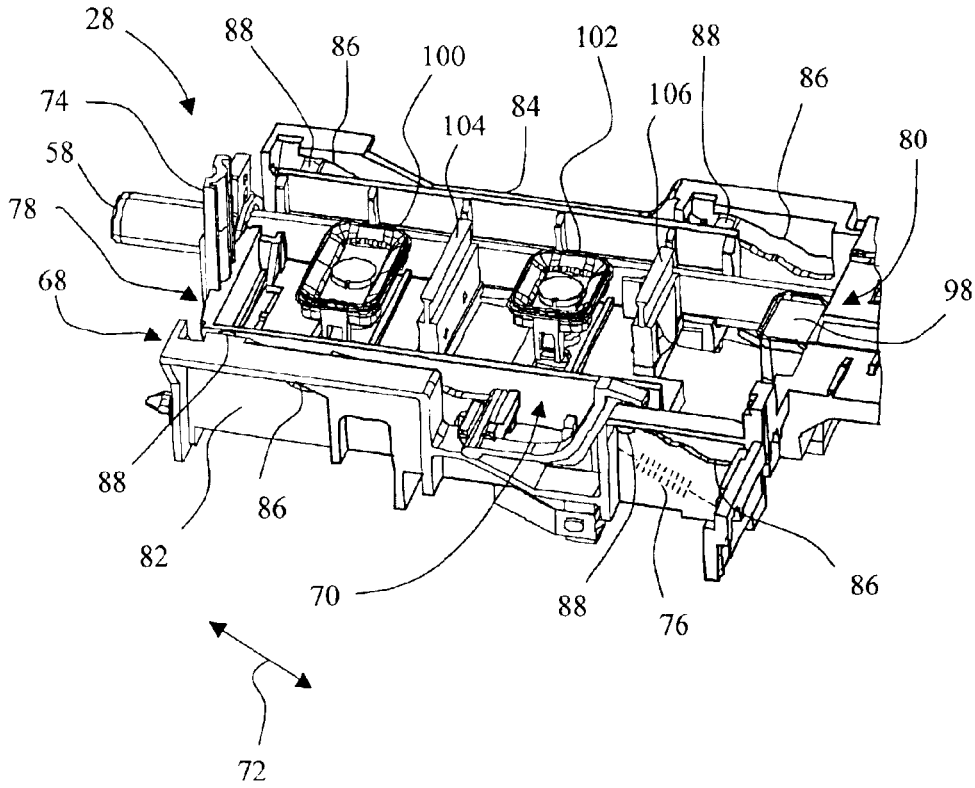
FIG. 2 is a perspective view of a maintenance station included in the imaging system of FIG. 1.

As shown in FIG. 2, maintenance housing 68 includes a first end portion 78, a second end portion 80, a first side 82 and a second side 84. First end portion 78 is spaced apart from second end portion 80, and first side 82 is spaced apart from second side 84. First side 82 and second side 84 have formed therein a plurality of guide slots, referenced herein individually and collectively with element number 86.

Maintenance sled 70 is positioned between first end portion 78 and second end portion 80, and is positioned between first side 82 and second side 84. Maintenance sled 70 has a plurality guide members, referenced herein individually and collectively with element number 88. Each of the plurality of guide members 88 is positioned to slideably travel in a corresponding one of plurality of guide slots 86. Thus, maintenance sled 70 is movably mounted to maintenance housing 68 via the interaction between guide slots 86 and guide members 88.

Figure 3:
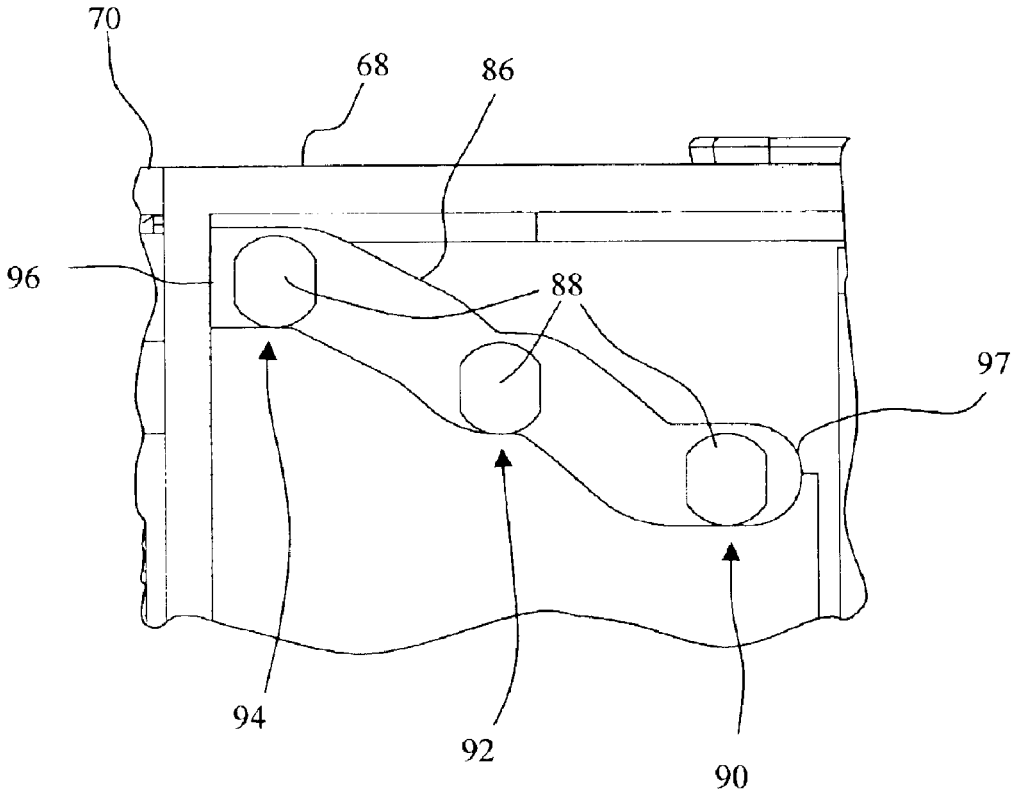
FIG. 3 is a close-up partial side view illustrating three elevations associated with the maintenance sled of the maintenance station of FIG. 2.

FIG. 3 shows a close-up partial side view of a guide slot 86 showing an exemplary cam profile, shape and orientation thereof. One guide member 88 of maintenance sled is shown in each of three exemplary elevations: a lowered, or spitting, position 90; an intermediate, or wiping, position 92; and a fully raised, or capping, position 94. Also, as best seen in FIG. 3, each of guide slots 86 has slot-ends 96, 97. A travel limit of maintenance sled 70 and a horizonal extent of the plurality of guide slots 86 are set such that the plurality of guide members 88 do not contact slot-ends 96, 97 of the plurality of guide slots 86.

Referring again to FIG. 2, second end portion 80 of maintenance housing 68 includes a spit chimney 98 for receiving waste ink from color ink jet printhead 38*b*.

Mounted to maintenance sled 70 are a monochrome printhead cap 100 and a color printhead cap 102. Also mounted to maintenance sled 70 are a flexible member 104 and a flexible member 106. Flexible member 104 serves as a monochrome printhead wiper. Flexible member 106 serves as a color printhead wiper and facilitates acoustical dampening in maintenance station 28.

Figure 4A:
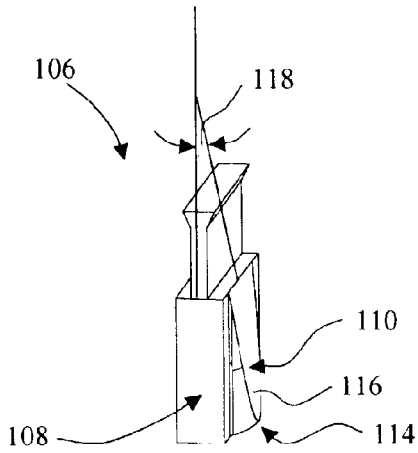
FIG. 4A is a perspective view of a printhead wiper of the maintenance station of FIGS. 1 and 2.
Figure 4B:
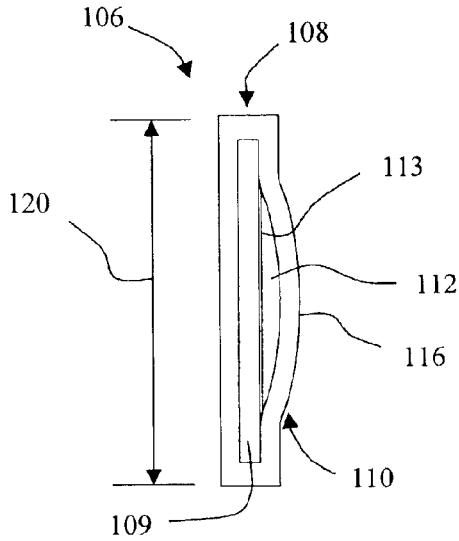
FIG. 4B is a bottom view of the printhead wiper of FIG. 4A.

Referring now to FIGS. 4A and 4B, flexible member 106 includes a main body 108 and an elastic portion 110 that extends outwardly from main body 108. Flexible member 106 may be made from an elastomer, such as a thermoplastic polyurethane material. Main body 108 defines a mounting recess 109. Main body 108 and elastic portion 110 define a cavity 112. As shown in FIG. 4B, an interior wall 113 separates mounting recess 109 from cavity 112. Mounting recess 109 is sized to snuggly receive a mounting post (not shown) of maintenance sled 70 in an interference fit. In the embodiment shown, cavity 112 has an open end 114 and has a volume filled with ambient air.

Elastic portion 110 includes a contact surface 116 that is positioned at an angle 118 with respect to an extent of main body 108. Thus, as shown, contact surface 116 is sloped and angles away from main body 108 in a direction toward open end 114. Also, contact surface 116 is formed in a shape of an arc in at least one dimension, e.g., along a width 120 of main body 108. The slope of contact surface 116, i.e., the angular extent of angle 118, is selected to attempt to minimize normal forces exerted on maintenance housing 68 by the two guide members 88 nearest to first end portion 78, when contact surface 116 contacts spit chimney 98 of second end portion 80.

During operation of maintenance sled 70, maintenance sled 70 transitions from the intermediate position 92 to the lowered position 90. When sled 70 reaches lowered position 90, elastic portion 110 of flexible member 106 contacts end portion 80 of maintenance housing 68. More particularly, in the embodiment shown, elastic portion 110 of flexible member 106 contacts spit chimney 98 when maintenance sled is in the lowered, i.e., spit or rest, position 90. Thus, elastic portion 110 of flexible member 106 sets a travel limit of maintenance sled 70 such that the plurality of guide members 88 do not contact slot-ends 97 of the plurality of guide slots 86 (see FIG. 3).

Figure 5A:
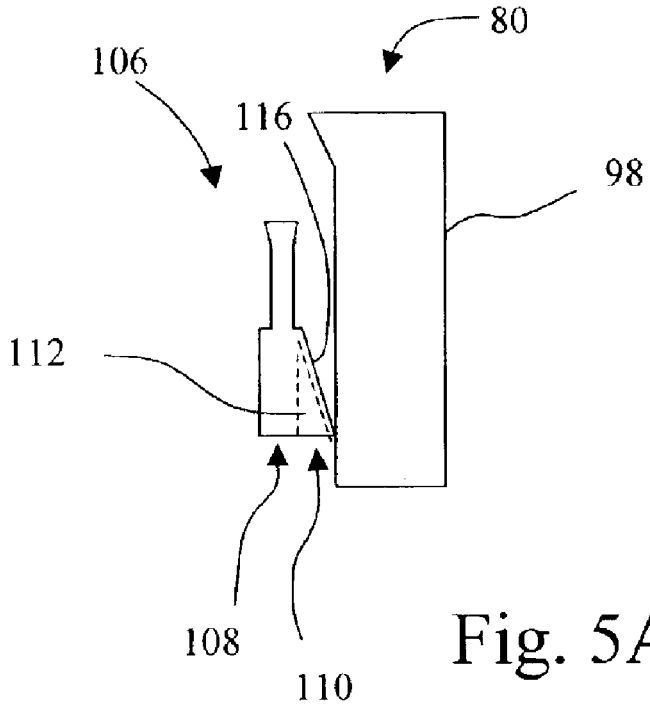
FIG. 5A is a diagrammatic illustration of the printhead wiper of FIGS. 4A and 4B with an elastic portion in a non-deformed state.
Figure 5B:
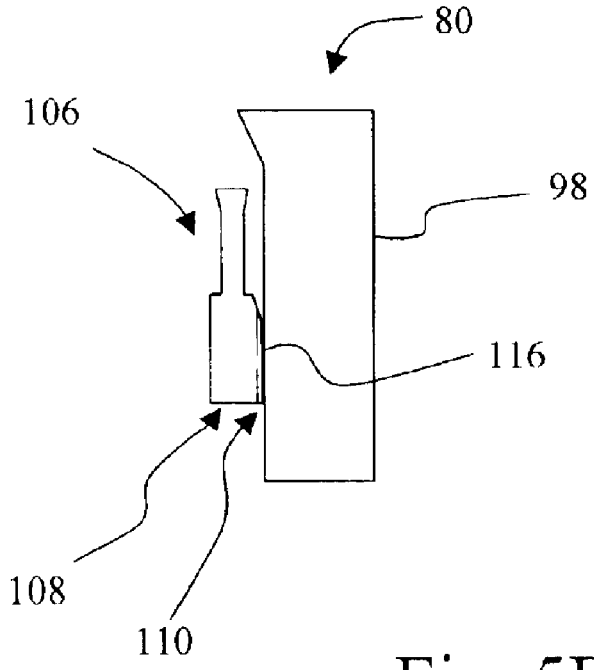
FIG. 5B is a diagrammatic illustration of the printhead wiper of FIG. 5B with the elastic portion in a deformed state.

FIG. 5A illustrates when elastic portion 110 of flexible member 106 initially engages spit chimney 98 of end portion 80 of maintenance station 28 when sled 70 reaches lowered position 90. FIG. 5B illustrates when elastic portion 110 of flexible member 106 has fully engaged spit chimney 98 of end portion 80 of maintenance station 28 when maintenance sled 70 reaches lowered position 90. As shown in FIG. 5B, elastic portion 110 deforms, thereby decreasing a volume of cavity 112 while elastic portion 110 is in a state of deformation. Accordingly, the kinetic energy of maintenance sled 70 as maintenance sled 70 is being lowered to the lowered position 90 is absorbed through the deformation of elastic portion 110 of flexible member 106. As a result, maintenance sled 70 is brought to a halt without the plastic maintenance sled 70 contacting the plastic maintenance housing 68, and without the plurality of guide members 88 contacting slot-ends 97 of the plurality of guide slots 86, hereby providing an acoustical dampening for maintenance station 28.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a frame; and a maintenance station coupled to said frame, said maintenance station including:

a maintenance housing having an end portion;

a maintenance sled movably mounted to said maintenance housing, said maintenance sled having a first position and a second position; and a flexible member mounted to said maintenance sled, said flexible member including a main body and an elastic portion extending from said main body, said main body and said elastic portion defining a cavity, said elastic portion of said flexible member contacting said end portion of said maintenance housing when said maintenance sled is in said first position.

2. The imaging apparatus of claim 1, wherein said first position is a lowered position.

3. The imaging apparatus of claim 1, wherein said flexible member is a printhead wiper.

4. The imaging apparatus of claim 1, wherein said flexible member is made from a thermoplastic polyurethane material.

5. The imaging apparatus of claim 1, wherein as said elastic portion of said flexible member engages said end portion of said maintenance station, said elastic portion deforms thereby decreasing a volume of said cavity while said elastic portion is in a state of deformation.

6. The imaging apparatus of claim 1, wherein said elastic portion includes a contact surface that is at an angle with respect to an extent of said main body.

7. The imaging apparatus of claim 6, wherein said contact surface is in a shape of an arc in at least one dimension.

8. The imaging apparatus of claim 7, wherein said arc is formed along a width of said main body.

9. The imaging apparatus of claim 8, wherein said flexible member is a printhead wiper.

10. The imaging apparatus of claim 1, said maintenance housing having a first side and a second side, said first side being spaced apart from said second side, said first side and said second side having formed therein a plurality of guide slots, each of said plurality of guide slots having slot-ends; and said maintenance sled being positioned between said first side and said second side, said maintenance sled having a plurality guide members, each of said plurality of guide members being positioned to slideably travel in a corresponding one of said plurality of guide slots, wherein a travel limit of said maintenance sled is set such that said plurality of guide members do not contact said slot-ends of said plurality of guide slots.

11. The imaging apparatus of claim 1, wherein said end portion of said maintenance housing includes a spit chimney, said elastic portion of said flexible member contacting said spit chimney of said maintenance housing when said maintenance sled is in said first position.

12. The imaging apparatus of claim 11, wherein as said elastic portion engages said spit chimney of said maintenance station, said elastic portion deforms thereby decreasing a volume of said cavity while said elastic portion is in a state of deformation.

13. A method of providing acoustical dampening in a maintenance station for an imaging apparatus, comprising the steps of:

providing a maintenance sled movably mounted to a maintenance housing having an end portion, said maintenance sled having a lowered position and an elevated position;

providing a flexible member mounted to said maintenance sled, said flexible member including a main body and an elastic portion extending from said main body, said main body and said elastic portion defining a cavity; and moving said maintenance sled toward said lowered position, said elastic portion of said flexible member contacting said end portion of said maintenance housing thereby deforming said elastic portion.

14. The method of claim 13, wherein said deforming results in a decreasing of a volume of said cavity while said elastic portion is in a state of deformation.

15. A printhead wiper, comprising:

a body, said body defining a mounting recess; and an elastic portion extending from said body, said body and said elastic portion defining a cavity.

16. The printhead wiper of claim 15, wherein said elastic portion is made from an elastomer.

17. The printhead wiper of claim 15, wherein upon a deformation of said elastic portion a volume of said cavity is decreased.

18. The printhead wiper of claim 15, wherein said elastic portion includes a contact surface that is at an angle with respect to an extent of said body.

19. The printhead wiper of claim 18, wherein said contact surface is in a shape of an arc in at least one dimension.

20. The printhead wiper of claim 19, wherein said arc is formed along a width of said body.

21. The printhead wiper of claim 15, wherein an interior wall separates said mounting recess from said cavity.

* * * * *